US010305169B2

(12) United States Patent
Zhang et al.

(10) Patent No.: US 10,305,169 B2
(45) Date of Patent: May 28, 2019

(54) ANTENNA APPARATUS AND TERMINAL

(71) Applicant: Huawei Technologies Co., Ltd., Shenzhen (CN)

(72) Inventors: Chen Zhang, Xi'an (CN); Jianfei Wang, Shenzhen (CN); Bing Liu, Xi'an (CN); Shuhui Sun, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/575,247

(22) PCT Filed: May 18, 2015

(86) PCT No.: PCT/CN2015/079205

§ 371 (c)(1),
(2) Date: Nov. 17, 2017

(87) PCT Pub. No.: WO2016/183777

PCT Pub. Date: Nov. 24, 2016

(65) Prior Publication Data

US 2018/0138579 A1 May 17, 2018

(51) Int. Cl.
*H01Q 21/00* (2006.01)
*H01Q 1/24* (2006.01)
(Continued)

(52) U.S. Cl.
CPC ..... *H01Q 1/243* (2013.01); *H01Q 1/24* (2013.01); *H01Q 5/335* (2015.01); *H01Q 5/357* (2015.01); *H01Q 21/30* (2013.01)

(58) Field of Classification Search
CPC ..... H01Q 1/243; H01Q 5/335; H01Q 5/357; H01Q 1/24; H01Q 21/30
(Continued)

(56) References Cited

U.S. PATENT DOCUMENTS 6,198,442 B1 3/2001 Rutkowski et al.
7,642,981 B2 * 1/2010 Kanno ..... H01Q 13/10 343/767

(Continued)

FOREIGN PATENT DOCUMENTS

CN 1364326 A 8/2002
CN 1661855 A 8/2005

(Continued)

OTHER PUBLICATIONS

Foreign Communication From a Counterpart Application, PCT Application No. PCT/CN2015/079205, English Translation of International Search Report dated Feb. 23, 2016, 2 pages.

(Continued)

*Primary Examiner* — Jean B Jeanglaude
(74) *Attorney, Agent, or Firm* — Conley Rose, P.C.

(57) ABSTRACT

An antenna apparatus includes a feeding terminal, a high-pass low-cut device, a first low-pass high-cut device, and an antenna body, where the high-pass low-cut device is electrically connected in series between a first free end of the antenna body and the feeding terminal, and the first low-pass high-cut device is electrically connected in series between a second free end of the antenna body and the feeding terminal.

18 Claims, 5 Drawing Sheets

(51) Int. Cl.
*H01Q 21/30* (2006.01)
*H01Q 5/357* (2015.01)
*H01Q 5/335* (2015.01)

(58) Field of Classification Search
USPC ..... 343/767, 853
See application file for complete search history.

(56) References Cited

U.S. PATENT DOCUMENTS

| | | | | |
|---|---|---|---|---|
| 7,701,407 | B2 * | 4/2010 | Kanno | H01Q 13/106 343/767 |
| 9,065,422 | B2 * | 6/2015 | Ishizuka | H03H 7/0115 |
| 2004/0204007 | A1 | 10/2004 | Ho et al. | |
| 2005/0190107 | A1 | 9/2005 | Takagi et al. | |
| 2011/0206097 | A1 | 8/2011 | Darden, IV | |
| 2012/0242552 | A1 | 9/2012 | Nishi et al. | |
| 2013/0027254 | A1 | 1/2013 | Korva et al. | |
| 2013/0027260 | A1 | 1/2013 | Jeon et al. | |
| 2016/0248155 | A1 * | 8/2016 | Montgomery | H01Q 5/22 |

FOREIGN PATENT DOCUMENTS

| | | | |
|---|---|---|---|
| CN | 102694262 | A | 9/2012 |
| CN | 102904003 | A | 1/2013 |
| CN | 102918709 | A | 2/2013 |
| JP | 2008205680 | A | 9/2008 |

OTHER PUBLICATIONS

Foreign Communication From a Counterpart Application, PCT Application No. PCT/CN2015/079205, English Translation of Written Opinion dated Feb. 23, 2016, 7 pages.
Machine Translation and Abstract of Japanese Publication No. JP2008205680, dated Sep. 4, 2008, 9 pages.
Foreign Communication From a Counterpart Application, Chinese Application No. 201580042648.8, Chinese Office Action dated Jan. 16, 2019, 6 pages.

* cited by examiner

ANTENNA APPARATUS AND TERMINAL

CROSS-REFERENCE TO RELATED APPLICATION

This application is a U.S. National Stage of International Patent Application No. PCT/CN2015/079205 filed on May 18, 2015, which is hereby incorporated by reference in its entirety.

TECHNICAL FIELD

The present disclosure relates to the communications technologies, and in particular, to an antenna apparatus and a terminal.

BACKGROUND

With continuous evolution of communications networks, wireless terminals having a multi-mode communication capability have gradually become a key development direction for the future in the industry. The multiple modes may be, for example, Global System for Mobile Communications (GSM), Code Division Multiple Access (CDMA), Wideband Code Division Multiple Access (WCDMA), and Long Term Evolution (LTE).

As a quantity of LTE frequency bands increases, it is particularly important for a terminal antenna to have a wide band and to be miniaturized. Existing antenna design solutions for LTE mostly use a conventional antenna having a support, such as a planar inverted F antenna (PIFA).

However, an existing terminal antenna has a relatively large size, and costs of a support are relatively high.

SUMMARY

The present disclosure provides an antenna apparatus and a terminal in order to resolve a problem that a terminal antenna in other approaches has a relatively large size and costs relatively high.

According to a first aspect of the present disclosure, an antenna apparatus is provided, including a feeding terminal, a high-pass low-cut device, a first low-pass high-cut device, and an antenna body, where the high-pass low-cut device is electrically connected in series between a first free end of the antenna body and the feeding terminal, and the first low-pass high-cut device is electrically connected in series between a second free end of the antenna body and the feeding terminal.

According to the first aspect, in a first possible implementation manner, the antenna apparatus operates in a first frequency band, a second frequency band, and a third frequency band. The first frequency band includes a first frequency and a second frequency. The second frequency band includes a third frequency and a fourth frequency. The third frequency band includes a fifth frequency and a sixth frequency, and the antenna apparatus is inductive at the first frequency, the third frequency, and the fifth frequency, and is capacitive at the second frequency, the fourth frequency, and the sixth frequency.

According to the first possible implementation manner, in a second possible implementation manner, a first connection end and a second connection end are disposed on the antenna body, and the high-pass low-cut device is electrically connected to the first connection end, the first connection end is electrically connected to the second connection end, and the second connection end is electrically connected to the first low-pass high-cut device.

According to a second aspect of the present disclosure, a terminal is provided, including a printed circuit board (PCB) and the antenna apparatus according to the first aspect, where a feeding apparatus is disposed on the PCB, and the feeding terminal is electrically connected to the feeding apparatus.

The present disclosure provides an antenna apparatus, including a feeding terminal, a high-pass low-cut device, a first low-pass high-cut device, and an antenna body, where the high-pass low-cut device is electrically connected in series between a first free end of the antenna body and the feeding terminal, and the first low-pass high-cut device is electrically connected in series between a second free end of the antenna body and the feeding terminal. According to the antenna apparatus provided in the embodiments, a high-pass low-cut device and a first low-pass high-cut device are added between a legacy antenna body and feeding terminal such that performance of the antenna can be ensured, that is, it is ensured that enough frequency bands are covered by the antenna. Further, as compared with an antenna having a support in the other approaches, primary antenna headroom of an ordinary antenna having a support in the other approaches has a length of 13 millimeters (mm), a width of 58 mm, and a height of at least 3 mm, while primary antenna headroom of the antenna apparatus provided in the present disclosure has a length of 13 mm and a width of 58 mm, and a height of the headroom may be negligible because the antenna apparatus may be printed on the surface of a PCB. Therefore, the antenna apparatus has a smaller size and lower costs.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show some embodiments of the present disclosure, and a person of ordinary skill in the art may still derive other drawings from these accompanying drawings without creative efforts.

DESCRIPTION OF EMBODIMENTS

To make the objectives, technical solutions, and advantages of the embodiments of the present disclosure clearer, the following clearly describes the technical solutions in the embodiments of the present disclosure with reference to the accompanying drawings in the embodiments of the present disclosure. The described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
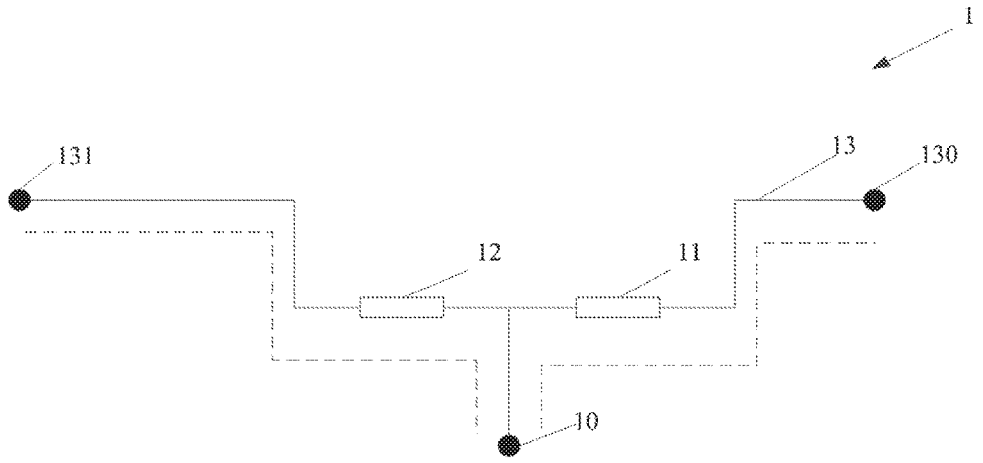
FIG. 1 is a schematic structural diagram of an antenna apparatus according to Embodiment 1 of the present disclosure.

FIG. 1 is a schematic structural diagram of an antenna apparatus 1 according to Embodiment 1 of the present disclosure. As shown in FIG. 1, the antenna apparatus 1 includes a feeding terminal 10, a high-pass low-cut device 11, a first low-pass high-cut device 12, and an antenna body 13.

Further, the high-pass low-cut device 11 is electrically connected in series between a first free end 130 of the antenna body 13 and the feeding terminal 10, and the first low-pass high-cut device 12 is electrically connected in series between a second free end 131 of the antenna body 13 and the feeding terminal 10.

In addition, the feeding terminal 10 is configured to electrically connect to a feedpoint of a feeding circuit in a terminal in which the antenna apparatus 1 is located. The terminal herein may be a mobile device, a user terminal, a wireless communications device, or the like. The feeding circuit is configured to provide an input signal to the antenna apparatus 1, and may be further configured to provide a transmit signal generated by a transmitter of the terminal to the antenna apparatus 1 after processing the signal, and after a signal is received by the antenna apparatus 1, transmit the received signal to a receiver of the terminal after processing the received signal.

The following describes an operating principle of the antenna apparatus 1 with reference to FIG. 1. It can be known according to the principle of electricity that, because the feeding terminal 10 is electrically connected to the first low-pass high-cut device 12, a feeding current from the feedpoint may flow along a path from the first low-pass high-cut device 12 to the second free end 131 in order to realize low frequency radiation using a low-pass high-cut feature of the first low-pass high-cut device 12. In an actual application, a suitable low-pass high-cut device may be selected to make the low frequency branch cover a low frequency band by means of a resonance of a first mode, and make the low frequency branch cover a high frequency band by means of a resonance of a second mode. Further, when in a high frequency band, a feeding current from the feedpoint may flow along a path from the high-pass low-cut device 11 to the first free end 130 in order to realize high frequency radiation using a high-pass low-cut feature of the high-pass low-cut device 11. The two paths are represented by dashed lines in FIG. 1. In this way, a low frequency resonance may be formed in a low frequency mode, and two high frequency resonances may be formed in a high frequency mode.

It should be noted that, according to the principle of electromagnetic waves, a resonance may be realized when a wavelength of an electromagnetic wave matches a length of an antenna. Because the first low-pass high-cut device 12 operates in a low frequency band, and the high-pass low-cut device 11 operates in a high frequency band, a length from the feeding terminal 10 to the second free end 131 on the antenna body 13 is relatively long in order to generate a low frequency resonance of the first mode and generate a high frequency resonance of the second mode, and a length from the feeding terminal 10 to the first free end 130 on the antenna body 13 is relatively short in order to generate a high frequency resonance. It should be noted that the description is given herein using an example in which the antenna apparatus 1 can generate three resonances, that is, the antenna apparatus 1 can cover three frequency bands. In an actual application, however, values of the first low-pass high-cut device 12 and the high-pass low-cut device 11 and a specific length of the antenna body 13 may be selected according to an actual quantity of frequency bands covered by the antenna apparatus 1. This is not limited herein.

In addition, a shape of the antenna apparatus 1 shown in FIG. 1 is merely an example, and the antenna apparatus 1 is not limited thereto.

For specific device selection, optionally, in an actual application, the first low-pass high-cut device 12 may be an inductor. Operating in a low frequency band, the inductor can effectively excite a low frequency electromagnetic wave, which is equivalent to reducing a part of a length of the antenna body 13, that is, an actual cable length of the antenna body 13. In this way, an actual size of the antenna apparatus 1 may be reduced such that the antenna apparatus 1 is more suitable for an ultra-thin mobile phone, and support costs may be lowered.

The antenna apparatus 1 provided in this embodiment of the present disclosure includes the feeding terminal 10, the high-pass low-cut device 11, the first low-pass high-cut device 12, and the antenna body 13. The high-pass low-cut device 11 is electrically connected in series between a first free end 130 of the antenna body 13 and the feeding terminal 10, and the first low-pass high-cut device 12 is electrically connected in series between a second free end 131 of the antenna body 13 and the feeding terminal 10. According to the antenna apparatus 1 provided in this embodiment, the high-pass low-cut device 11 and the first low-pass high-cut device 12 are added between the antenna body 13 and the feeding terminal 10 such that performance of the antenna can be ensured, that is, it is ensured that enough frequency bands are covered by the antenna. Further, as compared with an antenna having a support in the other approaches, primary antenna headroom of an ordinary antenna having a support in the other approaches has a length of 13 mm, a width of 58 mm, and a height of at least 3 mm, while primary antenna headroom of the antenna apparatus 1 provided in the present disclosure has a length of 13 mm and a width of 58 mm, and a height of the headroom may be negligible because the antenna apparatus 1 may be printed on the surface of a PCB. Therefore, the antenna apparatus 1 has a smaller size and lower costs.

Figure 2:
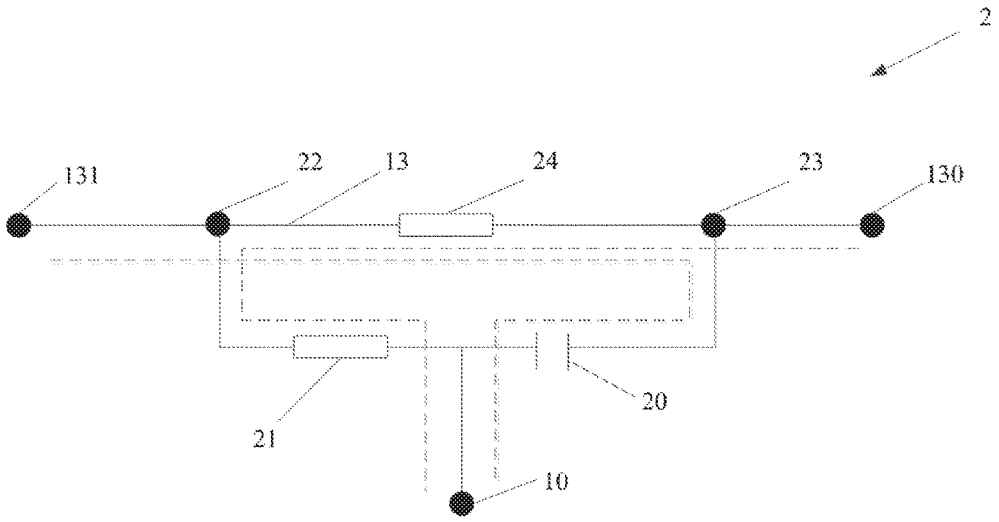
FIG. 2 is a schematic structural diagram of an antenna apparatus according to Embodiment 2 of the present disclosure.

FIG. 2 is a schematic structural diagram of an antenna apparatus 2 according to Embodiment 2 of the present disclosure. As shown in FIG. 2, the antenna apparatus 2 includes a feeding terminal 10, an antenna body 13, a capacitor 20, and an inductor 21. In addition, a first connection end 22 and a second connection end 23 are disposed on the antenna apparatus 2.

Further, the inductor 21 is electrically connected to the first connection end 22, the first connection end 22 is electrically connected to the second connection end 23, and the second connection end 23 is electrically connected to the capacitor 20. As shown in FIG. 2, a shape of the antenna apparatus 2 is similar to "π".

The following further describes an operating principle of the antenna apparatus 2 with reference to FIG. 2.

Similar to FIG. 1, a feeding current from a feedpoint may flow along a path from the inductor 21 to the first connection end 22, to the second connection end 23, and then to a first free end 130 in order to realize low frequency radiation using a low-pass high-cut feature of the inductor 21. The following refers to the path as a first path. In addition, a feeding current from the feedpoint may flow along a path that is from the capacitor 20 to the second connection end 23, to the first connection end 22, and then to a second free end 131 in order to realize high frequency radiation using a high-pass low-cut feature of the capacitor 20. The following refers to the path as a second path. As described in the foregoing embodiment, in this case, a low frequency band can be covered by means of a resonance of a first mode that is generated on the first path, a high frequency band can be covered by means of a resonance of a second mode that is generated on the first path, and a high frequency band can be covered by means of a high frequency resonance on the second path, that is, the antenna apparatus 2 covers three frequency bands in total.

Optionally, in an actual application, values of the inductor 21 and the capacitor 20 and specific positions of the first connection end 22 and the second connection end 23 on the antenna body 13 may be determined by configuring a specific value of an electronic device, that is, be determined according to an operating frequency of the antenna apparatus 2 to make the antenna apparatus 2 operate in a preset frequency band. Further, the antenna apparatus 2 may operate in a first frequency band, a second frequency band, and a third frequency band. The first frequency band includes a first frequency and a second frequency. The second frequency band includes a third frequency and a fourth frequency. The third frequency band includes a fifth frequency and a sixth frequency, and the antenna apparatus 2 is inductive at the first frequency, the third frequency, and the fifth frequency, and is capacitive at the second frequency, the fourth frequency, and the sixth frequency. The first frequency band corresponds to a low frequency resonance of the first mode of the antenna apparatus 2, the second frequency band corresponds to a high frequency resonance of the antenna apparatus 2, and the third frequency band corresponds to a low frequency resonance of the second mode of the antenna apparatus 2.

Figure 3A:
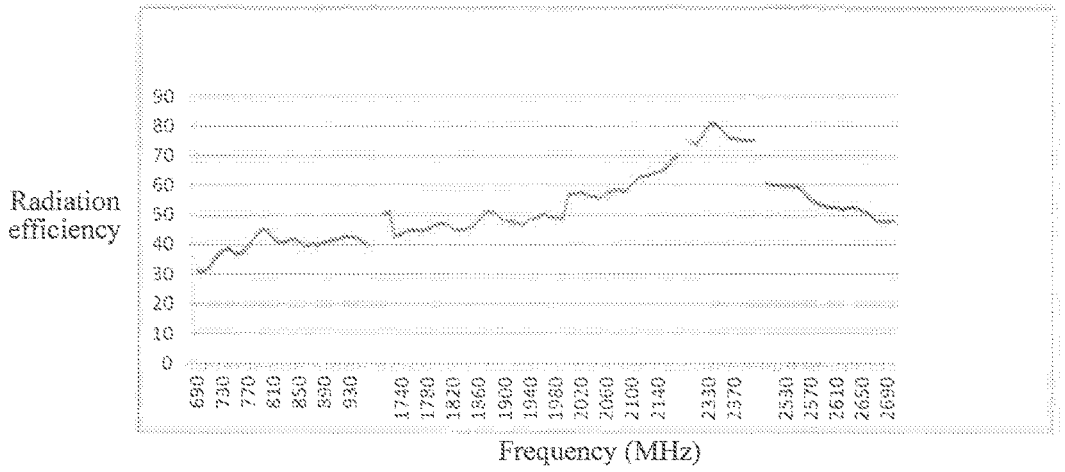
FIG. 3A is a schematic diagram of radiation efficiency of an antenna apparatus according to Embodiment 2 of the present disclosure.
Figure 3B:
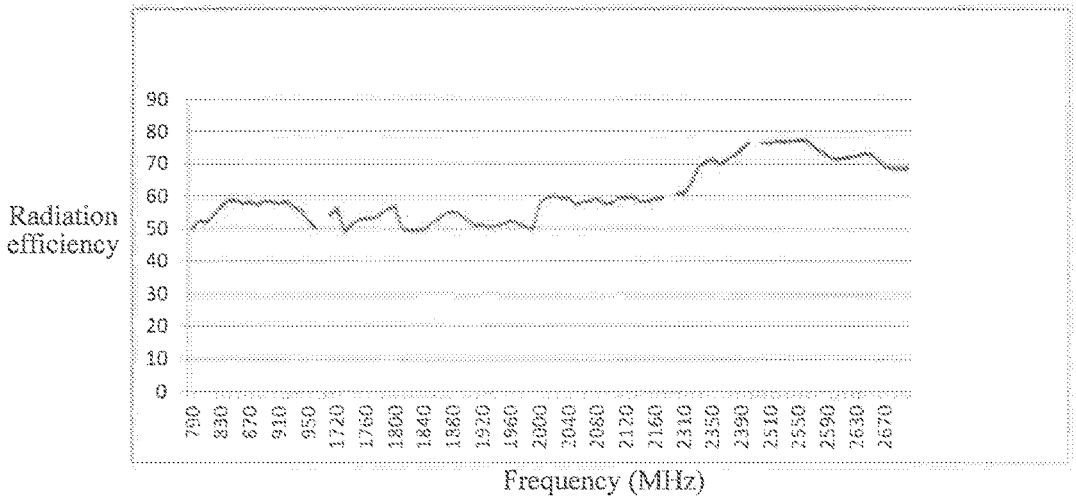
FIG. 3B is a schematic diagram of radiation efficiency of an antenna apparatus according to Embodiment 2 of the present disclosure.

Actual performance of the antenna apparatus 2, that is, radiation efficiency of the antenna apparatus 2, is shown in FIG. 3A and FIG. 3B. FIG. 3A and FIG. 3B respectively select different device parameters. FIG. 3A is a radiation efficiency diagram in frequency bands required to support the LTE frequency division duplex (FDD) and time division duplex (TDD). FIG. 3B is a radiation efficiency diagram in frequency bands required to support the Pan-European FDD and TDD. Pan-European frequency bands refer to frequency bands 790 megahertz (MHz) to 960 MHz and 1710 MHz to 2690 MHz. In fact, frequency bands of most European operators are included in the two frequency bands. Using FIG. 3A as an example, a horizontal axis represents operating frequencies of the antenna apparatus 2, in unit of MHz, and a vertical axis represents radiation efficiency of the antenna apparatus 2, where a specific value of the radiation efficiency is in a form of percentage. For example, if a vertical coordinate corresponding to a frequency is 90, it indicates that radiation efficiency of the antenna apparatus 2 at the frequency is 90%. It can be seen from FIG. 3A that, a frequency band B28, that is, a frequency band 698 MHz to 960 MHz, is included in the frequency bands covered by the antenna apparatus 2, a low frequency efficiency of the antenna apparatus 2 is above 30%, and a high frequency efficiency of the antenna apparatus 2 is above 45%, which can satisfy frequency bands that are required by the LTE FDD and TDD. From FIG. 3B, it can be seen that the frequency bands covered by the antenna apparatus 2 include frequency bands 791 MHz to 960 MHz and 1710 MHz to 2690 MHz, that is, include the Pan-European FDD and TDD frequency bands.

Optionally, the antenna apparatus 2 may further include a second low-pass high-cut device. Further, the second low-pass high-cut device may also be an inductor, that is, an inductor 24 shown in FIG. 2. A specific connection position of the inductor 24 may be that two ends of the inductor 24 are electrically connected to the first connection end 22 and the second connection end 23 respectively. The inductor 24 is disposed to further reduce the length of the antenna body 13.

In addition, the antenna apparatus 2 may further include a low-cut high-pass filtering network. The low-cut high-pass filtering network is electrically connected to the first free end 130 of the antenna body 13. A specific parameter design of the low-cut high-pass filtering network may be determined according to a high operating frequency of the antenna apparatus 2 in order to better match high frequency radiation performed by the antenna apparatus 2.

Figure 4A:
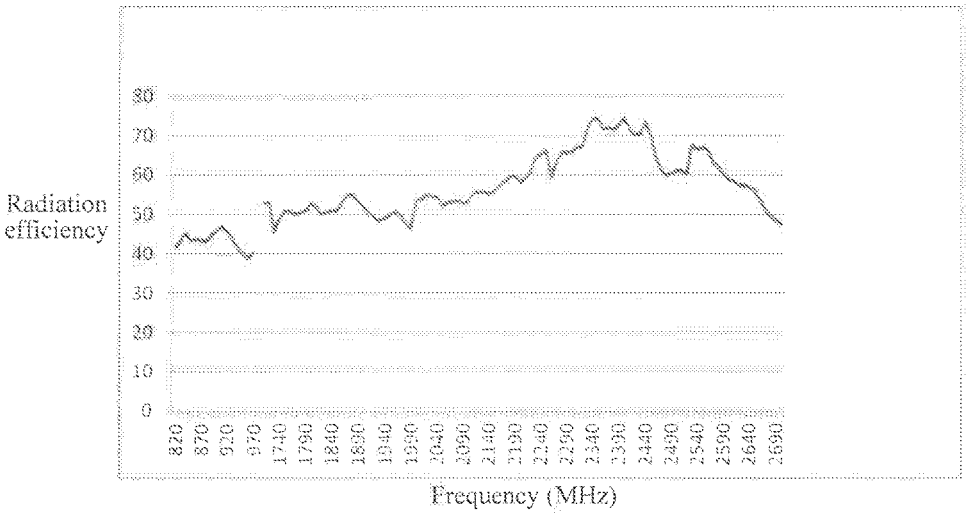
FIG. 4A is a schematic diagram of radiation efficiency of an antenna apparatus according to Embodiment 2 of the present disclosure.
Figure 4B:
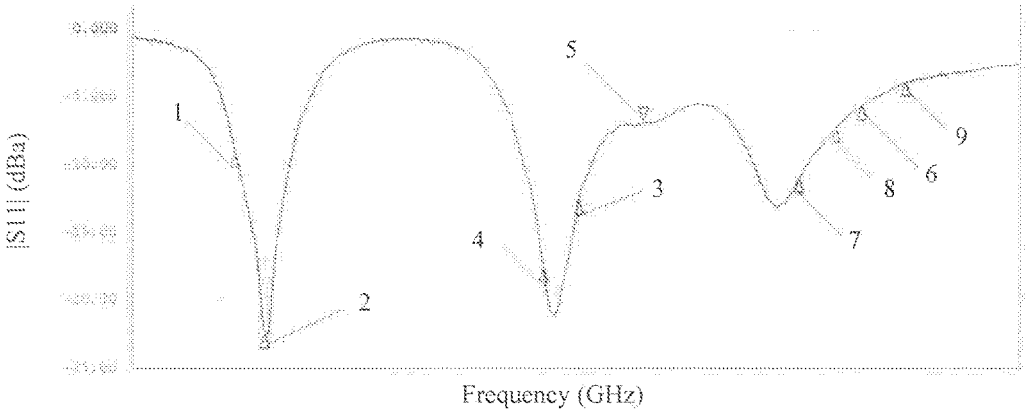
FIG. 4B is a diagram of a reflection factor of an antenna apparatus according to Embodiment 2 of the present disclosure.

It should be noted that in the antenna apparatus 2 shown in FIG. 2, the feeding terminal 10 may be located in a central axis of the antenna body 13, or may be offset to the left or right, and is not limited herein. A specific disposing manner of the feeding terminal 10 is determined by an actual operating frequency of the antenna apparatus 2. When the feeding terminal 10 is offset to the right to form an offset mode, a radiation efficiency diagram and a reflection factor diagram of the antenna are respectively shown in FIG. 4A and FIG. 4B. A horizontal axis in FIG. 4A represents an operating frequency, in unit of MHz, and a vertical axis represents radiation efficiency, where a specific value of the radiation efficiency is in a form of percentage. A horizontal axis in FIG. 4B represents an operating frequency of the antenna apparatus 2, in unit of gigahertz (GHz), and a vertical axis represents a reflection factor (designated as |S11|) of the antenna apparatus 2, in unit of weighted decibels (dBa). Frequencies corresponding to points marked by triangles in FIG. 4B are respectively 1 represents 880 MHz, 2 represents 960 MHz, 3 represents 1.8 GHz, 4 represents 1.71 GHz, 5 represents 1.98 GHz, 6 represents 2.57 GHz, 7 represents 2.4 GHz, 8 represents 2.5 GHz, and 9 represents 2.69 GHz. It can be seen that in FIG. 4B, the antenna apparatus 2 may cover three frequency bands of an ordinary LTE terminal, that is, a low frequency band 790 MHz to 960 MHz and high frequency bands 1710 MHz to 2170 MHz and 2520 MHz to 2690 MHz. When the antenna apparatus 2 in this application is applied as an example, by setting the length of the antenna body 13 of the antenna apparatus 2 and further selecting values for electronic devices of the antenna apparatus 2, the antenna apparatus 2 can be enabled to operate in the first frequency band 790 MHz to 960 MHz, the second frequency band 1710 MHz to 2170 MHz, and the third frequency band 2520 MHz to 2690 MHz. Specific methods of setting a capacitor value or an inductor value are the same as those in the other approaches, and details are not described herein.

Accordingly, the first frequency of the antenna apparatus 2 is 790 MHz, the second frequency is 960 MHz, the third frequency is 1710 MHz, the fourth frequency is 2170 MHz, the fifth frequency is 2520 MHz, and the sixth frequency is 2690 MHz.

Figure 4C:
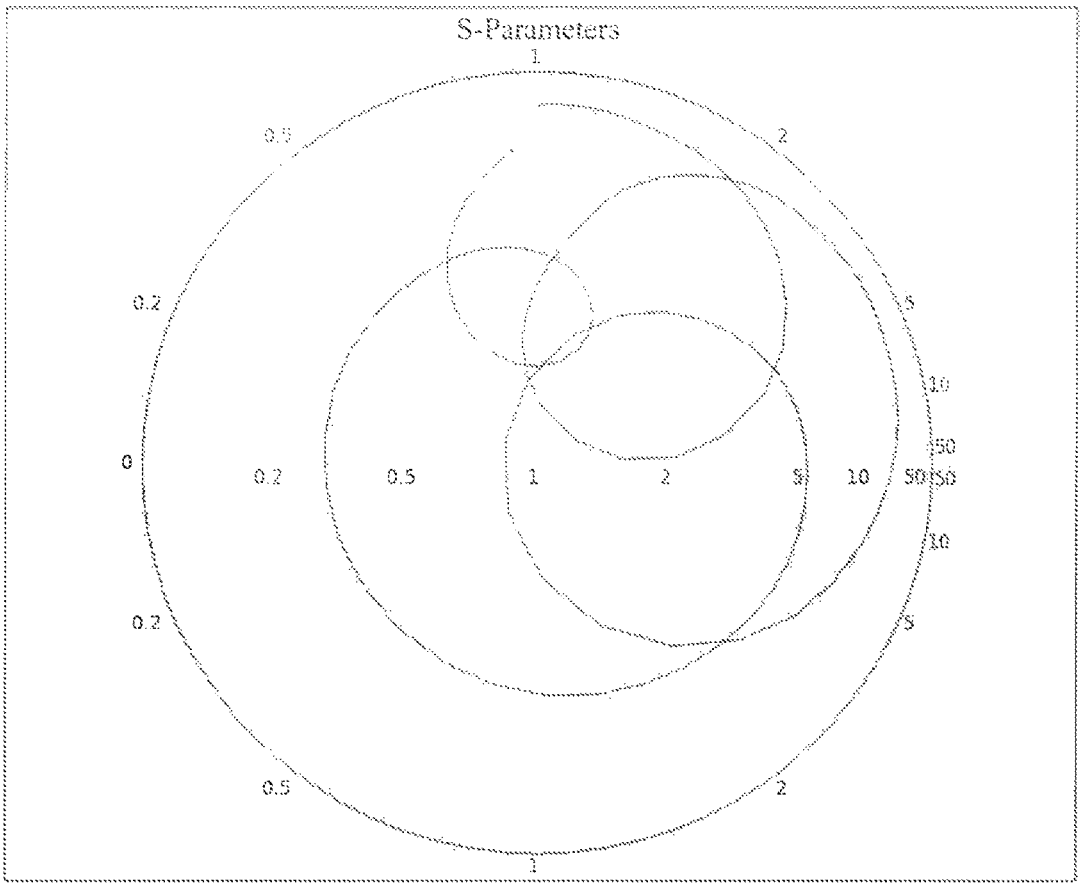
FIG. 4C is a Smith chart of an antenna apparatus according to Embodiment 2 of the present disclosure.

The antenna apparatus 2 generates a resonance in each of the three frequency bands. It can be known according to the principle of antennas that a resonance point indicates that input impedance of the antenna apparatus is a real number, that is, an imaginary part of the input impedance is zero. The zero input impedance corresponds to a real number axis in FIG. 4C, that is, a horizontal straight line marked with a real number in FIG. 4C. Two sides of the real number axis respectively represent inductive reactance and capacitive reactance of the antenna apparatus 2. Further, if the imaginary part of the input impedance is greater than zero, that is, when a frequency is located above the real number axis, it indicates that the antenna apparatus 2 is inductive at the frequency. If the imaginary part of the input impedance is less than zero, that is, when a frequency is located below the real number axis, it indicates that the antenna apparatus 2 is capacitive at the frequency. Drawings and details are not given herein. In addition, it should be noted that in an actual application, the inductor or capacitor described above may be a centralized inductor or capacitor, or may be a distributed inductor or capacitor, and is not limited herein.

The antenna apparatus 2 provided in this embodiment of the present disclosure includes the feeding terminal 10, the capacitor 20, an inductor 21, and the antenna body 13. The capacitor 20 is electrically connected in series between a first free end 130 of the antenna body 13 and the feeding terminal 10, and the inductor 21 is electrically connected in series between a second free end 131 of the antenna body 13 and the feeding terminal 10. According to the antenna apparatus 2 provided in this embodiment, the capacitor 20 and inductor 21 are added between the antenna body 13 and feeding terminal 10 such that performance of the antenna can be ensured, that is, it is ensured that enough frequency bands are covered by the antenna. Further, as compared with an antenna having a support in the other approaches, primary antenna headroom of an ordinary antenna having a support in the other approaches has a length of 13 mm, a width of 58 mm, and a height of at least 3 mm, while primary antenna headroom of the antenna apparatus provided in the present disclosure has a length of 13 mm and a width of 58 mm, and a height of the headroom may be negligible because the antenna apparatus 2 may be printed on the surface of a PCB. Therefore, the antenna apparatus 2 has a smaller size and lower costs.

Figure 5:
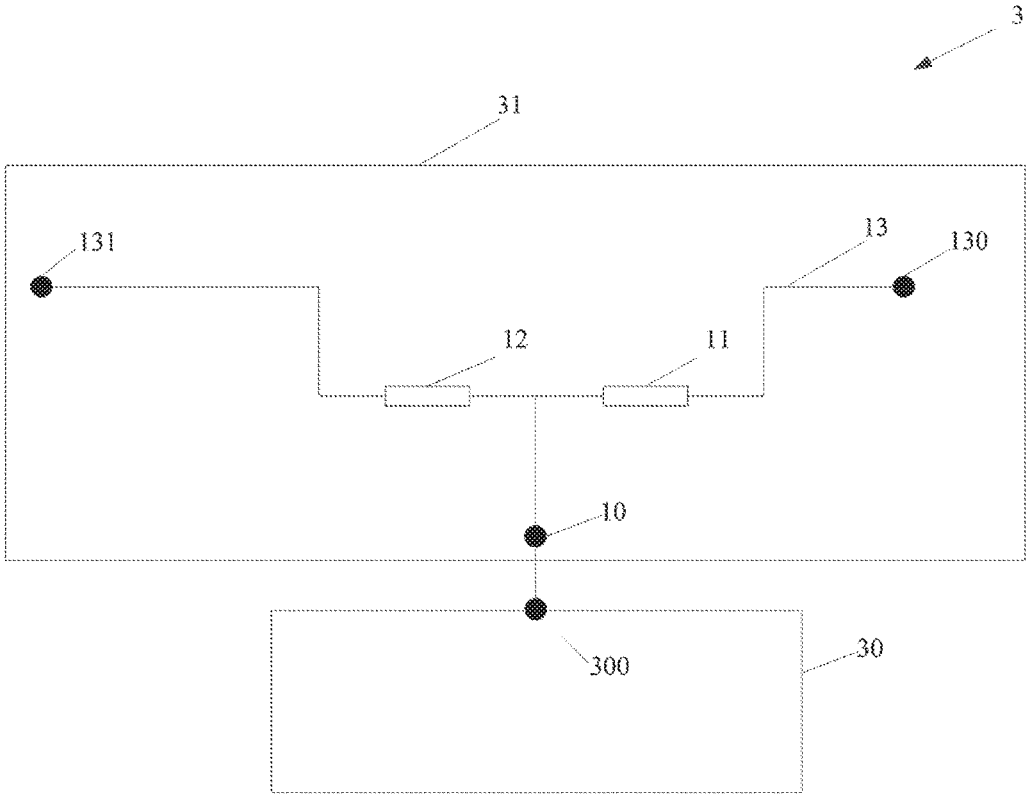
FIG. 5 is a schematic structural diagram of a terminal according to Embodiment 3 of the present disclosure.

FIG. 5 is a schematic structural diagram of a terminal 3 according to Embodiment 3 of the present disclosure. As shown in FIG. 5, the terminal 3 includes a PCB 30 and an antenna apparatus 31.

Further, a feeding apparatus 300 is disposed on the PCB 30, and the antenna apparatus 31 may be any antenna apparatus described in Embodiment 1 and Embodiment 2. For example, as shown in FIG. 5, the antenna apparatus 31 is the antenna apparatus 1 in Embodiment 1, and a feeding terminal 10 in the antenna apparatus 31 is electrically connected to the feeding apparatus 300.

The antenna apparatus 31 provided in this embodiment of the present disclosure includes the feeding terminal 10, a high-pass low-cut device 11, a first low-pass high-cut device 12, and an antenna body 13. The high-pass low-cut device 11 is electrically connected in series between a first free end 130 of the antenna body 13 and the feeding terminal 10, and the first low-pass high-cut device 12 is electrically connected in series between a second free end 131 of the antenna body 13 and the feeding terminal 10. According to the antenna apparatus 31 provided in this embodiment, the high-pass low-cut device 11 and the first low-pass high-cut device 12 are added between the antenna body 13 and feeding terminal 10 such that performance of the antenna can be ensured, that is, it is ensured that enough frequency bands are covered by the antenna. Further, as compared with an antenna having a support in the other approaches, primary antenna headroom of an ordinary antenna having a support in the other approaches has a length of 13 mm, a width of 58 mm, and a height of at least 3 mm, while primary antenna headroom of the antenna apparatus provided in the present disclosure has a length of 13 mm and a width of 58 mm, and a height of the headroom may be negligible because the antenna apparatus 31 may be printed on the surface of a PCB. Therefore, the antenna apparatus 31 has a smaller size and lower costs.

Finally, it should be noted that the foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present disclosure.

What is claimed is:

1. An antenna apparatus, comprising:

a feeding terminal;

a high-pass low-cut device;

a first low-pass high-cut device; and an antenna body, wherein the high-pass low-cut device is electrically coupled in series between a first free end of the antenna body and the feeding terminal, wherein the first low-pass high-cut device is electrically coupled in series between a second free end of the antenna body and the feeding terminal, wherein the antenna apparatus is configured to operate in a first frequency band, a second frequency band, and a third frequency band, wherein the first frequency band comprises a first frequency and a second frequency, wherein the second frequency band comprises a third frequency and a fourth frequency, wherein the third frequency band comprises a fifth frequency and a sixth frequency, and wherein the antenna apparatus is further configured to be inductive at the first frequency, the third frequency, and the fifth frequency, and capacitive at the second frequency, the fourth frequency, and the sixth frequency.

2. The antenna apparatus according to claim 1, wherein a first connection end and a second connection end are disposed on the antenna body, wherein the high-pass low-cut device is electrically coupled to the first connection end, wherein the first connection end is electrically coupled to the second connection end, and wherein the second connection end is electrically coupled to the first low-pass high-cut device.

3. The antenna apparatus according to claim 2, further comprising a second low-pass high-cut device, wherein two ends of the second low-pass high-cut device are electrically coupled to the first connection end and the second connection end, respectively.

4. The antenna apparatus according to claim 3, wherein the second low-pass high-cut device comprises an inductor.

5. The antenna apparatus according to claim 1, further comprising a low-cut high-pass filter network that is electrically coupled to the first free end.

6. The antenna apparatus according to claim 1, wherein the high-pass low-cut device comprises a capacitor.

7. The antenna apparatus according to claim 1, wherein the first low-pass high-cut device comprises an inductor.

8. The antenna apparatus according to claim 1, wherein the antenna apparatus is further configured to support long term evolution (LTE) frequency division duplex (FDD) and LTE time division duplex (TDD).

9. The antenna apparatus according to claim 1, wherein the first frequency comprises 790 megahertz (MHz), wherein the second frequency comprises 960 MHz, wherein the third frequency comprises 1710 MHz, wherein the fourth frequency comprises 2170 MHz, wherein the fifth frequency comprises 2520 MHz, and wherein the sixth frequency comprises 2690 MHz.

10. A terminal, comprising:

a printed circuit board; and an antenna apparatus, wherein a feeding apparatus is disposed on the printed circuit board, wherein a feeding terminal of the antenna apparatus is electrically coupled to the feeding apparatus, and wherein the antenna apparatus comprises:

the feeding terminal;

a high-pass low-cut device;

a first low-pass high-cut device; and an antenna body, wherein the high-pass low-cut device is electrically coupled in series between a first free end of the antenna body and the feeding terminal, wherein the first low-pass high-cut device is electrically coupled in series between a second free end of the antenna body and the feeding terminal, wherein the antenna apparatus is configured to operate in a first frequency band, a second frequency band, and a third frequency band, wherein the first frequency band comprises a first frequency and a second frequency, wherein the second frequency band comprises a third frequency and a fourth frequency, wherein the third frequency band comprises a fifth frequency and a sixth frequency, and wherein the antenna apparatus is further configured to be inductive at the first frequency, the third frequency, and the fifth frequency, and capacitive at the second frequency, the fourth frequency, and the sixth frequency.

11. The terminal according to claim 10, wherein a first connection end and a second connection end are disposed on the antenna body, wherein the high-pass low-cut device is electrically coupled to the first connection end, wherein the first connection end is electrically coupled to the second connection end, and wherein the second connection end is electrically coupled to the first low-pass high-cut device.

12. The terminal according to claim 11, further comprising a second low-pass high-cut device, wherein two ends of the second low-pass high-cut device are electrically coupled to the first connection end and the second connection end, respectively.

13. The terminal according to claim 12, wherein the second low-pass high-cut device comprises an inductor.

14. The terminal according to claim 10, further comprising a low-cut high-pass filter network that is electrically coupled to the first free end.

15. The terminal according to claim 10, wherein the high-pass low-cut device comprises a capacitor.

16. The terminal according to claim 10, wherein the first low-pass high-cut device comprises an inductor.

17. The terminal according to claim 10, wherein the antenna apparatus is further configured to support long term evolution (LTE) frequency division duplex (FDD) and LTE time division duplex (TDD).

18. The terminal according to claim 10, wherein the first frequency comprises 790 megahertz (MHz), wherein the second frequency comprises 960 MHz, wherein the third frequency comprises 1710 MHz, wherein the fourth frequency comprises 2170 MHz, wherein the fifth frequency comprises 2520 MHz, and wherein the sixth frequency comprises 2690 MHz.

* * * * *